US006854928B2

(12) United States Patent
Lockwood

(10) Patent No.: US 6,854,928 B2
(45) Date of Patent: Feb. 15, 2005

(54) PRECAST CONCRETE CULVERT SYSTEM

(75) Inventor: William D. Lockwood, Dayton, OH (US)

(73) Assignee: Con/Span Bridge Systems Ltd., Dayton, OH (US)

( * ) Notice: Subject to any disclaimer, the term of this patent is extended or adjusted under 35 U.S.C. 154(b) by 0 days.

(21) Appl. No.: 10/353,477

(22) Filed: Jan. 29, 2003

(65) Prior Publication Data

US 2003/0143029 A1 Jul. 31, 2003

Related U.S. Application Data

(60) Provisional application No. 60/352,958, filed on Jan. 30, 2002.

(51) Int. Cl.[7] ..... E01F 5/00

(52) U.S. Cl. ..... 405/124; 52/88; 52/89

(58) Field of Search ..... 14/24, 26; 52/88, 52/89, 79.14, 293.1; 405/124–126, 52–53, 286

(56) References Cited

U.S. PATENT DOCUMENTS

| | | | | | |
|---|---|---|---|---|---|
| 597,281 | A | * | 1/1898 | Geisel | 52/87 |
| 862,292 | A | * | 8/1907 | Stoffer | 52/89 |
| 925,019 | A | * | 6/1909 | Parks | 52/89 |
| 954,410 | A | * | 4/1910 | Gossett | 52/89 |
| 1,761,306 | A | * | 6/1930 | McKeown | 249/18 |
| 3,256,653 | A | * | 6/1966 | Huff | 52/89 |
| 4,558,969 | A | * | 12/1985 | FitzSimons | 405/124 |
| 4,826,639 | A | * | 5/1989 | Vidal et al. | 264/32 |
| 4,983,070 | A | * | 1/1991 | Hwang | 405/124 |
| 4,993,872 | A | | 2/1991 | Lockwood | |
| 5,199,819 | A | * | 4/1993 | Matiere | 405/149 |
| 5,207,038 | A | * | 5/1993 | Negri | 52/169.6 |
| 5,281,053 | A | * | 1/1994 | Matiere | 405/149 |
| 6,050,746 | A | * | 4/2000 | McCavour et al. | 405/124 |
| 6,129,484 | A | * | 10/2000 | Chiaves | 405/134 |
| 2002/0046521 | A1 | * | 4/2002 | Steinacker | 52/274 |

FOREIGN PATENT DOCUMENTS

WO 94/12728 * 6/1994

OTHER PUBLICATIONS

The MATIERE mono–arche publication, undated.

* cited by examiner

*Primary Examiner*—Sunil Singh
(74) *Attorney, Agent, or Firm*—Jacox, Meckstroth & Jenkins

(57) ABSTRACT

A three piece concrete culvert system includes a set of horizontally spaced precast side wall sections having inwardly projecting and opposing steps or surfaces which support opposite ends of a precast arched top wall section. The side wall sections include extension portions which project substantially above the ends of the top wall section for increasing the capacity of the side wall sections to resist thrust from the top wall section. Vertically spaced and generally horizontal layers of soil reinforcement members or grids may be positioned within the soil backfilled adjacent the outer surfaces of the side wall sections, and precast concrete anchor members may be attached to the side wall sections above supporting footers for the side wall sections. Shims are used between the footers and the anchor members for temporarily positioning and aligning the side wall sections before receiving the top wall section.

10 Claims, 1 Drawing Sheet

PRECAST CONCRETE CULVERT SYSTEM

BACKGROUND OF THE INVENTION

In a precast open bottom culvert system, for example, as disclosed in U.S. Pat. No. 4,993,872 which issued to the assignee of the present invention, the handling and shipping restrictions with respect to weight, height and width of each precast open bottom one-piece culvert unit has limited the maximum span for a culvert system. For example, with a culvert system having a span above 48 feet, the weight, height and length of each one-piece culvert unit present problems with shipping the unit along a roadway on a low bed semi-trailer.

SUMMARY OF THE INVENTION

The present invention is directed to a precast concrete culvert system wherein each unit has a three piece construction, including a pair or set of precast concrete side wall sections. The wall sections are mounted on and supported by corresponding concrete footers and have inwardly projecting and opposing support steps or surfaces which forms seats for opposite ends of a precast concrete arched top wall section. The side wall sections include extension portions which project upwardly substantially above the support surfaces for the ends of the top wall section for substantially increasing the capacity of the side wall sections to resist thrust from the arched top wall section. A temporary cable ties or connects opposite end portions of the arched top wall section during shipping and handling and is removed after the side wall sections are backfilled with compacted soil.

Precast concrete anchor members, such as the anchor members disclosed in above mentioned U.S. Pat. No. 4,993,872, may be attached to the side wall sections and project into the backfilled soil, and one or more shims may be positioned between the anchor member and the supporting footer for each side wall section to obtain horizontal and vertical alignment of the side wall sections before receiving the top wall sections. The compacted backfill soil for the side wall sections, including the soil adjacent the extension portions, may be stabilized by vertically spaced layers of soil reinforcement members or grids for lowering the stress levels in each three section precast unit in order to reduce the concrete reinforcement required in the unit and/or the wall thickness of each precast section.

Other features and advantages of the invention will be apparent from the following description and the accompanying drawing.

DESCRIPTION OF THE PREFERRED EMBODIMENTS

Figure 1:
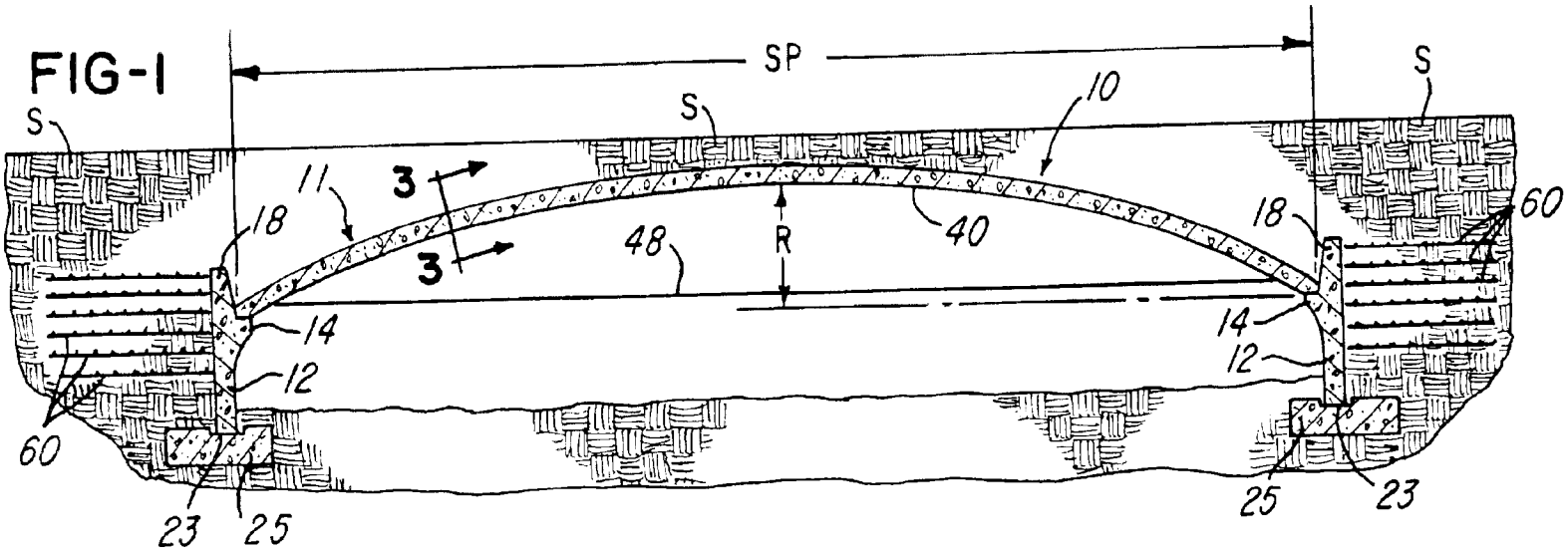
FIG. 1 is a vertical cross-section through a precast concrete culvert unit construction in accordance with the invention.
Figure 5:
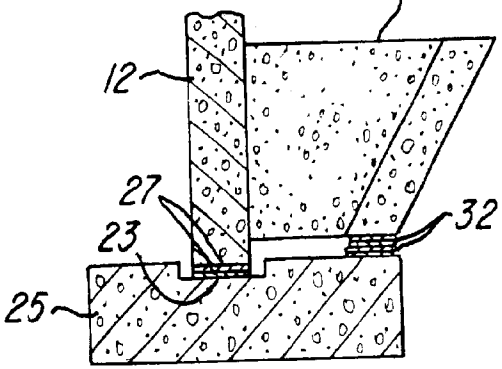
FIG. 5 is an enlarged fragmentary section of a wall section and anchor member supported by a footer, in accordance with a modification of the invention.

FIG. 1 illustrates a concrete culvert system 10 constructed in accordance with the invention and including one or more longitudinally aligned three piece precast culvert units 11 each having a pair of generally vertical and parallel spaced precast side wall sections 12 which have suitable embedded reinforcement members (not shown). Each wall section 12 has an intermediate step portion 14 of greater thickness and forming a supporting surface or seat 16. Each wall section 12 also includes an upwardly projecting an integrally cast extension portion 18 having an inclined inner surface 21 which projects upwardly and outwardly from the surface or seat 16. The bottom edge of each wall section 12 seats within a horizontal recess 23 formed within the top of a concrete footer 25 which is preferably cast in place and has embedded reinforcing members or rods (not shown). As shown in FIG. 5, one or more shims 27 may be placed within the recess 23 under the bottom surface of each wall section 12 for properly positioning and aligning the wall section before the recess 23 is filled with grout along the length of the wall section 12.

Each of the wall sections 12 has a predetermined length, for example, twelve feet, depending upon the thickness, weight and height of the wall section. As also shown in FIG. 5, one or more precast concrete wall anchors 30 may be attached to each wall section 12 and project laterally outwardly therefrom. Preferably, each of the wall anchors 30 is constructed and attached to the wall section as disclosed in the above-mentioned '872 patent, the disclosure of which is incorporated by reference, and is spaced above the top surface of the footer 25. In order to position each wall section 12 precisely vertical and in longitudinal alignment with corresponding wall sections 12 of other three piece culvert units, one or more shims 32 are positioned between the, bottom surface of the anchor 30 and the supporting footer 25.

Figure 2:
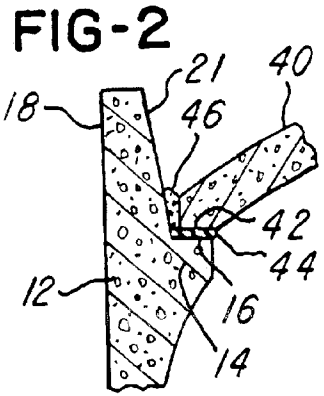
FIG. 2 is an enlarged fragmentary section of a wall section and roof section joint structure as shown in FIG. 1.

Each three piece culvert unit 11 also includes a precast arcuate or arched concrete top wall section 40 which has a predetermined width to provide a predetermined span SP between the inner surfaces of the spaced wall sections 12. For example, the top wall section 40 may provide a span SP from 48 feet to 80 feet or above. As shown in FIGS. 1 and 2, opposite end portions of the arched top wall section 40 are supported by the corresponding seats or support surfaces 16 on the side wall sections 12, and preferably, rubber pads 44 are positioned between each support surface 16 and the bottom end surface 42 of top wall section 40. Each top wall section 40 has a predetermined length L (FIG. 3), for example, between four feet and six feet. Thus each pair of opposing side wall sections 12 may support two or more top wall sections 40.

After the side wall sections 12 are erected and the end portions of the top wall sections 40 are seated on the resilient pads 44 and supported by the surfaces 16, grout 46 is inserted into the gaps between the opposite end surfaces of each top wall section 40 and the surfaces 16 and 21 of each side wall section 12. After each top wall section 40 is precast, opposite end portions of the section are tied together or connected by a temporary cable 48 to facilitate handling, storage and transporting the top wall section. After installation of all of the units 11 of the culvert system 10 is completed, and soil S is backfilled in back of the side wall sections 12 and over the top wall section 40, the cable 48 for each top wall section is removed.

Figure 3:
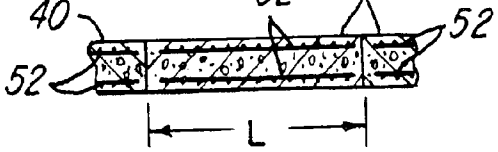
FIG. 3 is an enlarged fragmentary section taken generally on the line 3—3 of FIG. 1.
Figure 4:
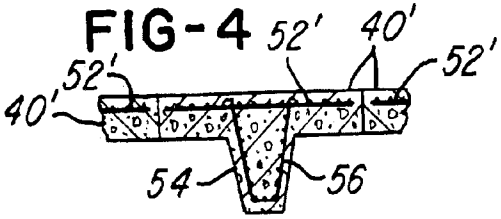
FIG. 4 is fragmentary section similar to FIG. 3 and showing a modification of a top wall section of the invention.

As also shown in FIG. 3, each of the arched or arcuate top wall sections 40 has upper and lower layers of concrete reinforcing members such as rods or grids 52 which extend the full length of the top wall section 40. The reinforcing members or rods may be formed of steel or of a composite material. FIG. 4 shows another form of top wall section 40' constructed in accordance with the invention and which includes an arcuate or arched rib 54 projecting downwardly and extending substantially the full length of the top wall section 40'. The end portions of the rib 54 may be tapered upwardly along the corresponding opposite end portions of the top wall section. The concrete reinforcing members 52' within each top wall section 40' are connected to reinforcing members 56 which project downwardly into the rib 54 along the length of the rib Referring again to FIG. 1, the structural performance of the precast concrete culvert unit 11 is determined by a complex interaction of the deflections of the culvert unit and the lateral support of the surrounding soil. The soil reactions on the side wall sections 12 of the culvert unit 11 mobilize an arch action in the curved or arch top wall section 40 of the unit. The thrust that can be mobilized and the lateral deflection necessary to produce the thrust are critical variables that determine the structural performance of the precast unit 11. Stabilizing the backfill of soil S adjacent the side wall sections decreases the lateral deflection necessary to produce the required arch thrust.

The soil stabilization is accomplished by multiple layers of reinforcing members or grids 60 which extend horizontally in vertically spaced layers within the compacted soil S adjacent the outer surfaces of the side wall sections 12. The reinforcement members 60 may be a geo-textile material or strip materials or a geo-grid, for example, as disclosed in U.S. Pat. No. 5,131,791., the disclosure which is incorporated by reference. The soil stabilization produced by the members 60 lowers the stress levels in each three-piece precast unit, thereby reducing the requirement for concrete reinforcement and/or reducing the wall thickness in the precast unit, and/or providing the unit with greater capacity to carry heavier loads and/or higher soil overfills. The soil reinforcement members 60 may be attached to the side wall sections 12 or may not be attached. The layers of soil reinforcement members 60 also cooperate with the wall anchors 30 to increase the effectiveness of the wall anchors. The combined effects are complimentary and result in a culvert system having wall sections which may be precast with substantial heights and/or support a top wall section having substantial span.

A concrete culvert system constructed in accordance with the invention provides desirable features and advantages. For example, each one-piece arched top wall section 40 is set directly on its final support surfaces 16 while the temporary cable 48 remains attached. This simplifies handling of the top wall section and provides for an efficient assembly of the top wall section. In addition, the extensions 18 of the side wall sections 12, extending upwardly substantially above the ends of the top wall section 40, and preferably at least thirty percent of the rise R, create a symmetrical reaction surface that greatly increases the capacity of the side wall sections to resist the thrust from the arched top wall section 40. Thus the invention provides for culvert units 11 having substantial heights as a result of the modularity of the top wall section and the ability to supply and transport side wall sections at any required height. This allows a total precast culvert system to satisfy conditions from low stream crossings to very high highway and railway underpasses.

As mentioned above, the lengths of the side wall sections 12 and top wall section 40 may be different and may be selected to optimize the weights of all of the precast wall sections 12 and 40 for handling and transporting the wall sections. The arched top wall section 40 may also be post-tensioned to improve its performance and to facilitate further the handling and shipping of the top wall section.

As also mentioned above in connection with FIG. 1, the vertical spaced layers of soil stabilization members 60 cooperate with the compacted backfilled soil S for each side wall section 12 and reduce the lateral deflection of the side wall sections by increasing the soil reaction. This also provides for significantly increasing the spans and heights of the three-piece culvert system 10 thereby significantly increasing the applications and uses of the culvert system 10.

While the forms of culvert system herein described constitute preferred embodiments of the invention, it is to be understood that the invention is not limited to these precise forms of culvert system, and that changes may be made therein without departing from the scope and spirit of the invention as defined in the appended claims.

What is claimed is:

1. A concrete culvert system installed within soil, comprising a set of horizontally spaced and substantially vertical precast concrete side wall sections, said side wall sections having upwardly facing support surfaces thereon, concrete support footers separate from said side wall sections and supporting bottom surfaces of said side wall sections and providing for tilting movement of each said side wall section relative to the corresponding said support footer and through a vertical plane, a precast concrete top wall section spanning the space between said side wall sections and having opposite end portions supported by said support surfaces, a precast concrete anchor member rigidly connected to each of said side wall sections and spaced above the corresponding said support footer, and each said anchor member projecting laterally outwardly from the corresponding said sidewall section above the corresponding said support footer and into the soil backfilled against said side wall section to provide for precisely and positively positioning said side wall sections prior to mounting said top wall section on said side wall sections.

2. A culvert system as defined in claim 1 and including adjustable rigid spacer members disposed between said support footers and laterally outer portions of said anchor members.

3. A culvert system as defined in claim 2 wherein said adjustable rigid spacer members comprise a plurality of spacer shims between each said anchor member and the corresponding said support footer.

4. A culvert system as defined in claim 1 wherein each of said concrete anchor members comprises an outer inclined flange wall connected to the corresponding said side wall section by a web wall disposed generally perpendicular to said side wall section.

5. A culvert system as defined in claim 1 wherein each said side wall section has a length longer than a length of said top wall section to provide for supporting a plurality of said top wall sections with a pair of parallel spaced said side wall sections.

6. A concrete culvert system installed within soil, comprising a set of horizontally spaced and substantially vertical precast concrete side wall sections, said side wall sections having upwardly facing support surfaces thereon, concrete support footers separate from said side wall sections and supporting bottom surfaces of said side wall sections and, providing for tilting movement of each said side wall section relative to the corresponding said support footer and through a vertical plane, a precast concrete top wall section spanning the space between said side wall sections and having opposite end portions supported by said support surfaces, each of said concrete side wall sections having an integral extension portion projecting upwardly substantially above the corresponding said end portion of said top wall section, a precast concrete anchor member rigidly connected to each of said side wall sections and spaced above the corresponding said support footer, and each said anchor member projecting laterally outwardly from the corresponding said side wall section above the corresponding said support footer and into the soil backfilled against said side wall section to provide for precisely and positively positioning said side wall sections prior to mounting said top wall section on said side wall sections.

7. A culvert system as defined in claim 6 and including adjustable rigid spacer members disposed between said support footers and laterally outer portions of said anchor members.

8. A culvert system as defined in claim 6 wherein said adjustable rigid spacer members comprise a plurality of spacer shims between each said anchor member and the corresponding said support footer.

9. A culvert system as defined in claim 6 wherein each of said concrete anchor members comprises an outer inclined flange wall connected to the corresponding said side wall section by a web wall disposed generally perpendicular to said side wall section.

10. A culvert system as defined in claim 6 wherein each said side wall section has a length longer than a length of said top wall section to provide for supporting a plurality of said top wall sections with a pair of parallel spaced said side wall sections.

* * * * *